United States Patent [19]

Paulson et al.

[11] 4,026,261

[45] May 31, 1977

[54] COACTING WHEELS TYPE FOOTBALL THROWING DEVICE

[75] Inventors: John K. Paulson, Lake Oswego; Walter J. Steffan, Portland; Tommy L. Smith, Tualatin, all of Oreg.

[73] Assignee: Jo Paul Industries, Inc., Tualatin, Oreg.

[22] Filed: Mar. 6, 1975

[21] Appl. No.: 556,013

[52] U.S. Cl. ..... 124/78; 124/82; 273/55 R

[51] Int. Cl.[2] ..... F41B 11/00

[58] Field of Search ..... 124/1, 82, 78; 198/7 BL; 273/55 R, 26 D, 29 A

[56] References Cited

UNITED STATES PATENTS

| | | | |
|---|---|---|---|
| 2,737,941 | 3/1956 | Carrau | 124/78 |
| 2,918,915 | 12/1959 | Doeg | 124/1 |
| 3,774,584 | 11/1973 | Paulson | 124/1 |

*Primary Examiner*—Richard C. Pinkham
*Assistant Examiner*—William R. Browne
*Attorney, Agent, or Firm*—Oliver D. Olson

[57] ABSTRACT

A football is projected with rotation on its longitudinal axis, in the manner of a forward pass, when it is fed into the space between, and thereby gripped frictionally by, the laterally spaced, confronting surfaces of a pair of driven wheels which confronting surfaces move in a forward, football throwing direction but in planes which extend forward angularly to opposite sides of the line on which the football is projected, the planes forming an included acute angle with each other. The speed and direction of football rotation may be varied by adjusting said angular relationship, and the speed of forward projection of the football may be varied by adjusting the rotational speed of the wheels. By adjusting said confronting surfaces to a common plane and feeding a football into the space therebetween such that said surfaces grip the football below its longitudinal centerline, the football is projected therefrom with rotation on its transverse axis, in the manner of an end-over-end kick-off.

11 Claims, 7 Drawing Figures

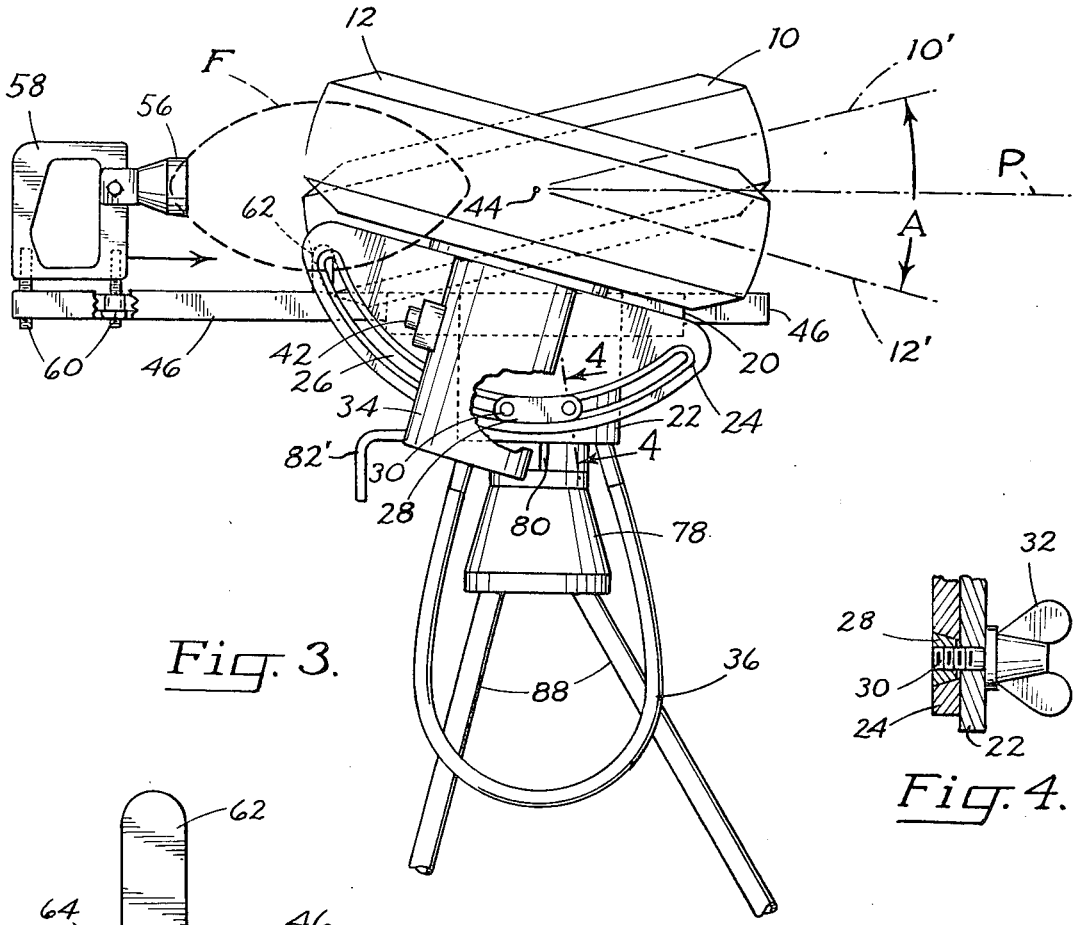
Fig. 3.
Fig. 4.
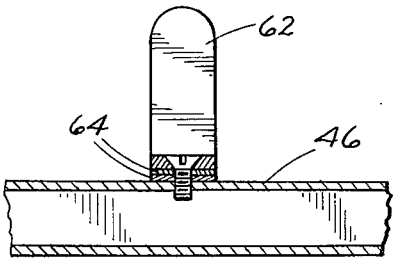
Fig. 7.
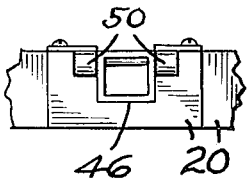
Fig. 6.
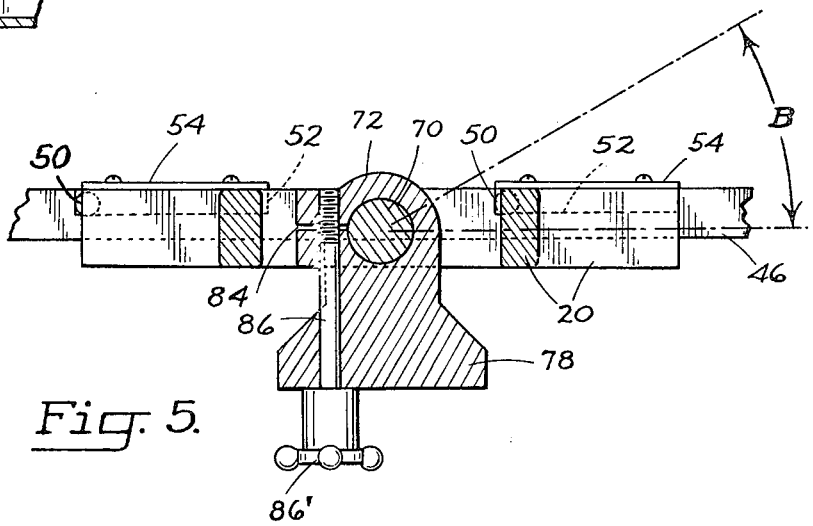
Fig. 5.

COACTING WHEELS TYPE FOOTBALL THROWING DEVICE

BACKGROUND OF THE INVENTION

This invention relates to ball throwing devices, and more particularly to a device by which to throw a football selectively with rotation on its longitudinal axis, in the manner of a forward pass, or on its transverse axis, in the manner of an end-over-end kick-off.

Although a wide variety of types of devices have been proposed heretofore for the throwing of various types of spherical balls, such as baseballs softballs, tennis balls, etc., no device has been proposed heretofore for the throwing of a football, either in the manner of a foward pass, of a punt, or of a kick-off. The value of such a device, however, is apparent: It would provide mechanical means by which receivers could practice pass reception maneuvers without involving the time of and possible arm injury to a quarterback. It would also provide practice for kick-off and punt return personnel without requiring the extending services of a kicker.

SUMMARY OF THE INVENTION

In its basic concept, the football throwing device of this invention involves the arrangement of a pair of driven members to provide a pair of laterally spaced, confronting, football gripping surfaces which move simultaneously in a forward, football throwing direction but are disposed in planes which form an included acute angle between them for projecting a football with rotation to its longitudinal axis, and are disposed in a common plane for projecting a football with rotation on its transverse axis, in the manner of an end-over-end kick-off.

It is by virtue of the foregoing basic concept that the principal objective of this invention is achieved; namely, to provide a device which is effective for throwing a football with rotation on its longitudinal axis, in the manner of a forward pass.

Another object of this invention is the provision of a football throwing device of the class described in which footballs may be thrown with clockwise or counterclockwise axial rotation, in the manner of a forward pass thrown from the right hand or from the left hand of a passer.

Still another objective of this invention is the provision of a football throwing device of the class described which is adjustable for throwing footballs over a wide range of distances with a wide range of speeds.

A further object of this invention is the provision of a football throwing device of the class described which is effective in projecting football with rotation on its transverse axis, in the manner of an end-over-end kick-off.

A still further object of this invention is the provision of a football throwing device of the class described which is of relatively simplified construction for economical manufacture and minimum cost of maintenance and repair.

The foregoing and other objects and advantages of his invention will appear from the following detailed description, taken in connection with the accompanying drawings of a preferred embodiment.

BRIEF DESCRIPTION OF THE DRAWINGS

FIG. 3 is a fragmentary view in side elevation as viewed from the right in FIG. 2.

FIG. 4 is a fragmentary sectional view taken on the line 4—4 in FIG. 3.

FIG. 5 is a fragmentary sectional view taken on line 5—5 in FIG. 2.

FIG. 6 is a fragmentary elevation as viewed from the left in FIG. 5.

FIG. 7 is a fragmentary sectional view taken on the line 7—7 in FIG. 1.

DESCRIPTION OF THE PREFERRED EMBODIMENT

Figure 1:
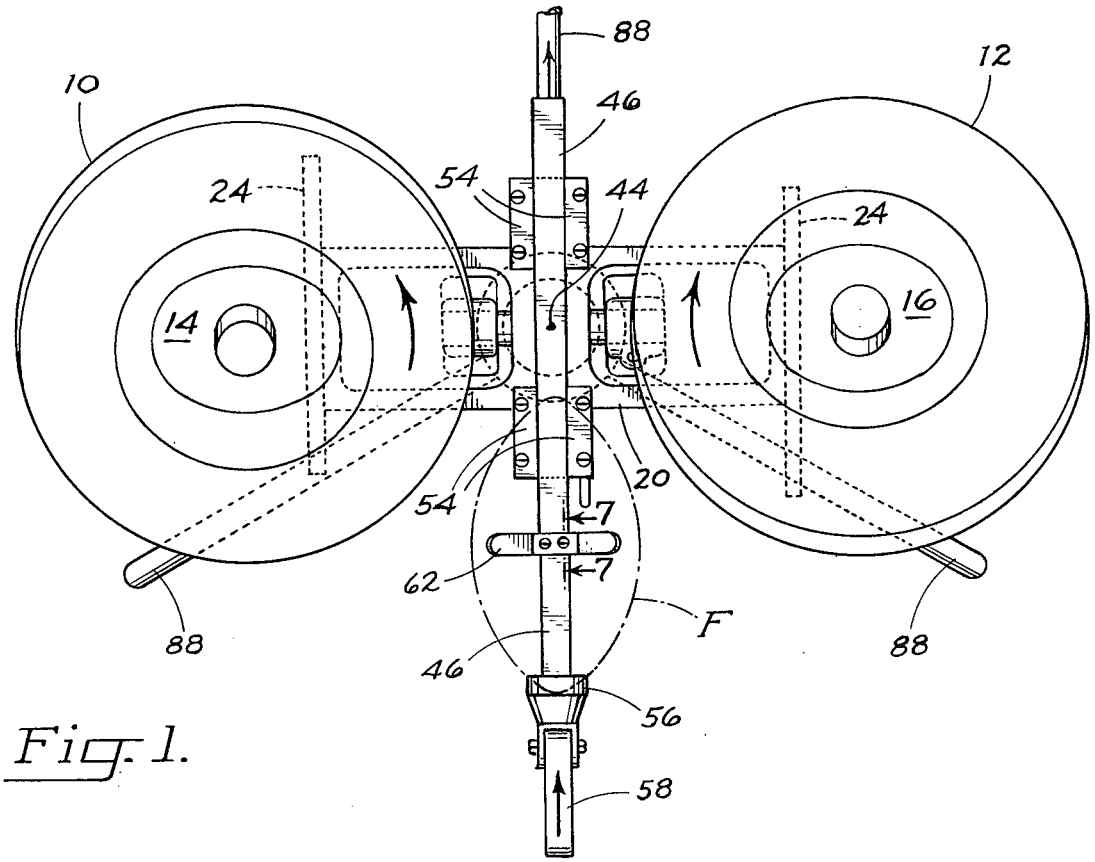
FIG. 1 is a plan view of a football throwing device embodying the features of this invention.
Figure 2:
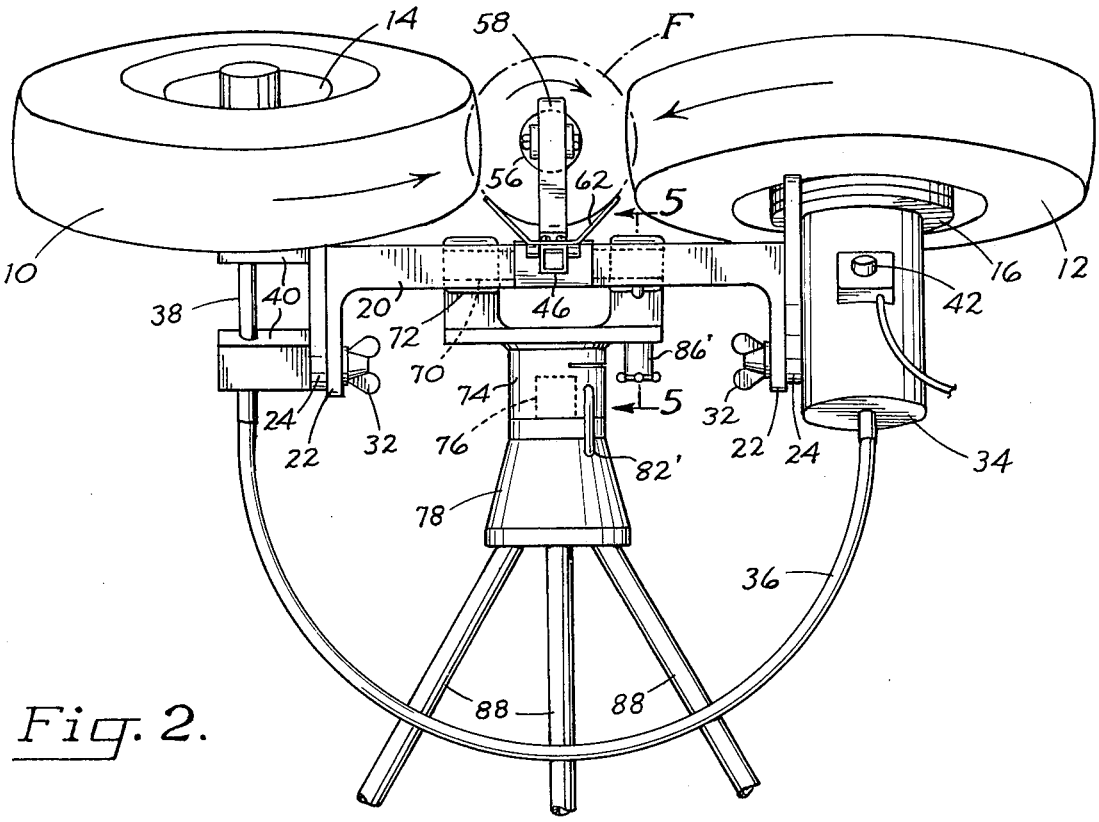
FIG. 2 is a fragmentary view in rear elevation as viewed from the bottom in FIG. 1.

In the embodiment illustrated, a pair of pneumatic tires 10 and 12, mounted on wheels 14 and 16, respectively, are spaced apart laterally so that the minimum distance between the confronting surfaces of the tires is slightly less then the maximum transverse diameter of a football F (FIG. 2). The wheels are driven, one clockwise and the other counterclockwise (FIG. 1), so that the confronting surfaces move simultaneously in the same direction, i.e. in a forward, football throwing direction.

In order for the football to be thrown with rotation on its longitudinal axis, in the manner of a forward pass, the forward movement of the confronting surfaces of tires 10 and 12 must be disposed in planes 10' and 12' (FIG. 3) offset from one another and forming an included acute angle A between them. The magnitude of this included angle may be varied over a considerable range to achieve a variety of rotational effects on a football. However, an included angle of about 30° has been found to provide projection of a football with optimum rotational speed. This is most suitable for the throwing of both long and short conventional passes as well as spiral type punts. Increasing the included angle increases the speed of axial rotation of the football, in the manner of an excessively hard thrown forward pass. Reducing the included angle decreases the rotational speed of the football and also causes the latter to wobble in flight, as in the manner of a softly thrown lob pass or of a punt.

Reducing the included angle A substantially to zero, i.e. by disposing both tires in substantially the same plane; reduces the speed of longitudinal rotation of the football to zero. Introducing the football into the space between the confronting surfaces, either slightly above the midplane or said confronting surfaces or slightly inclined forwardly relative thereto, such that the confronting surfaces grip the football below its longitudinal centerline, results in the football being projected with rotation on its transverse axis, in the manner of an end-over-end kick-off.

Means is provided for mounting the wheels in the above described laterally spaced and angularly disposed arrangement. Although they may be mounted in a fixed position, for example providing a fixed included angle A of about 30° for most general usage, the embodiment illustrated affords adjustment of the wheels through the full range of conditions described hereinbefore.

Thus, a mounting frame 20 extends transversely under the laterally spaced wheels and is provided at its opposite ends with downwardly extending flanges 22 (FIG. 2). An adjustment plate 24 abuts the outer side of each of the end flanges and is provided with an elongated arcuate groove 26 (FIG. 3) having outwardly tapered sides adapted to receive a correspondingly arcuate and transversely tapered (FIG. 4) clamping bar 28. The clamping bar is provided with a pair of spaced openings which are threaded to receive a pair of clamp screws 30. The clamp screws extend freely through openings in the flange 22 and are provided at their inner ends with wing nut type heads 32 for convenient hand manipulation.

Each of the plates 24 mounts one of the wheels for angular adjustment therewith. In the embodiment illustrated, the wheel 16 is mounted on the output shaft of an electric motor 34 which is secured to the associated plate. The output shaft of the motor extends through both ends of the motor housing, and the end of the output shaft opposite the wheel 16 is coupled to one end of an elongated flexible drive cable 36. The opposite end of the drive cable is coupled to one end of a shaft 38 journaled in bearings 40 secured to the other plate 24 at the opposite end of the frame. The opposite end of shaft 38 mounts the other wheel 14.

The use of the single drive motor and flexible cable not only minimizes cost of manufacture, but it also insures rotation of both wheels at the same speed. The drive motor is of the variable speed type which is adjustable by means of a control 42 positioned for convenient access to an operator of the device.

It is to be noted, particularly from FIGS. 2 and 3 of the drawings, that adjustment of the relative angular positions of the pair of tires, and hence the planes 10' and 12' of the confronting, forwardly moving surfaces thereof, is accomplished with speed, facility and precision simply by loosening the screws 30 sufficiently to allow the associated plate 24 to move arcuately relative to the clamping bar 28 along the arcuate groove 26. The radius of this groove is located at a point 44 (FIGS. 1 and 3) which is midway between the shortest distance between the confronting surfaces of the tires (FIG. 1) and also midway between the top and bottom edges of the confronting surfaces (FIG. 3). It is this point 44 that defines the apex of the included acute angle A formed by the off-set planes 10' and 12' of the forward movement of the confronting surfaces of the tires.

FIG. 2 illustrates the disposition of the tires for effecting projection of a football F with clockwise rotation on its longitudinal axis, in the manner of a forward pass thrown from the right hand. Reversal of the angular position of the tires, i.e. with the right hand tire 12 inclined forwardly and the left hand tire 10 declined forwardly, will result in projection of a football with a counterclockwise axial rotation, in the manner of a forward pass thrown from the left hand.

Means is provided for feeding a football into the space between the confronting surfaces of the tires. In the embodiment illustrated, an elongated carriage beam 46, preferably of hollow box construction for minimum weight, is mounted in a groove 48 (FIG. 6) provided in the frame along a longitudinal center line between the confronting surfaces of the tires. The beam is movable along the groove with minimum friction by means of supporting rollers 50 which extend laterally to opposite sides of the beam and track in grooves 52 provided in the frame 20 adjacent the opposite sides of longitudinal groove 48.

The length of the track grooves 52 limits the distance of reciprocation of the beam 46 in the forward and rearward directions. These grooves are covered by plates 54 secured to the frame, as by screws, to prevent upward displacement of rollers 50 and hence of beam 46, relative to the frame 20.

Mounted on the rearward end of the beam is a socket member 56 for receiving and positioning the rearward end of a football F. In the embodiment illustrated, the socket member is adjustable vertically relative to the beam 46. For this purpose the socket member is secured to a handle member 58, as by the bolt illustrated. The handle member, in turn, is mounted on the beam for vertical adjustment, as by means of a pair of screws 60 (FIG. 3) secured to the beam by means which prevents longitudinal displacement of the screws but allows for their axial rotation.

A cradle type support 62 also is mounted on the beam 46 forwardly of the socket member 56 for supporting a football intermediate its ends. The cradle member is secured to the beam by such means as the screws illustrated. It also preferably is adjustable vertically relative to the beam by such means as one or more shims 64 (FIG. 7) interposed between the beam and the overlying intermediate portion of the cradle member.

It is by virtue of the adjustability of the socket member 56 and cradle member 62 that a football may be adjusted in position on the carriage beam 46 for aligning its longitudinal axis selectively on the apex point 44 or above it or inclined relative to it. Once appropriately aligned, the handle 58 serves to reciprocate the carriage beam forward and rearward relative to the tires. Thus, in the rearwardly retracted position illustrated in FIG. 3, a football may be installed upon it, cradled intermediate its ends on the cradle member 62 and stabilized by its rearward end by engagement in the socket member 56. The carriage then is moved forwardly, by pushing forward on the handle, until the opposite sides of the football engage and thus are gripped frictionally by the forwardly moving confronting surfaces of the spaced tires. The football thereupon is projected forwardly from between the tires with simultaneous rotation on its longitudinal axis, in the manner of a forward pass.

As previously explained, the force with which the football is projected from between the wheels is adjustable by adjusting the rotational speed of the wheels, by the variable speed electric motor 34.

Means also is provided for adjusting the wheel assembly about horizontal and vertical axes. The vertical axis and a vertical plane through the horizontal axis both are disposed perpendicular to the projection line P, to accommodate projecting a football throughout a wide range of trajectories P (FIG. 3) and throughout a large horizontal arc. For this purpose, a transverse shaft 70 extends through the central portion of frame 20 and is journaled at its opposite ends in bearings 72 projecting upward from a turntable member 74. This latter member has an axial bore for reception of a cylindrical post 76 projecting upward from a tripod base 78. The turntable member is provided with a radial split 80 (FIG. 3), traversed by a clamping screw 82 having an off-set handle 82' by which to manipulate the screw to tighten and loosen the turntable member relative to the post. By this means the wheel assembly may be rotated about the vertical axis of post 76, to adjust the horizontal direction of projection of a football.

Adjustment of the vertical direction of projection P of a football is achieved by rotating the wheel-supporting frame 20 about the horizontal axis of transverse shaft 70, as exemplified by arc B in FIG. 5. One of the bearings 72 engaging the shaft is split as at 84 (FIG. 5), and the split sections are traversed by a clamping screw 86 provided with a hand grip knob 86' at its lower end. Accordingly, the split bearing may be tightened into and loosened from frictional clamping engagement with the shaft 70, whereby to releasably secure the wheel-supporting frame 20 in selected angular positions of adjustment.

The tripod base 78 below the post 76 serves to attach the upper ends of three elongated legs 88, arranged in tripod fashion, whereby the wheel assembly is supported above ground in stable condition.

To illustrate the operation of the device, let if first be assumed that the device is to be arranged to throw forward passes with optimum rotational speed and minimum trajectory. The angular relationship between the wheels is established at the optimum included angle of about 30° (FIG. 3), the approximate inclination of the line P on which the football is projected from between the wheels is adjusted by loosening the clamp screw 86 and rotating the wheel and frame assembly about the transverse axis of shaft 70, the clamp screw then is retightened, and the speed of rotation of the wheels then is adjusted by control 42 until the desired distance to which the football is thrown, is achieved. The inclination of projection line P may be readjusted as desired.

With the clamp screw 82 loosened to allow rotation of the turntable base 74 about the vertical axis of post 76, the line of projection may be adjusted through a horizontal arc to the desired down field position at which the football is to reach a receiver. The operator then retracts the carriage beam 46, installs a football F upon the cradle 62 with the rearward end of the football positioned in the socket member 56, and then the carriage is moved forward to bring the football into frictional engagement with the forwardly moving confronting surfaces of the tires 10 and 12. The football thereupon is projected forwardly from between the tires in the manner desired.

If it is desired to throw passes with greater than normal rotational speed, the included acute angle A between the planes 10' and 12' of the forwardly moving confronting surfaces of the tires is increased.

If it is desired to throw lob passes, the rotational speed of the wheels is reduced and the inclination of projection line P modified as required.

By reducing the angle A the football is caused to wobble, in the manner of a punt. The length of the punt may be varied by varying the rotational speed of the wheels.

In the event it is desired that the foregoing passes be thrown in the manner of a left handed passer, the angular dispostion of the wheels is reversed from the position illustrated in the drawings, to effect counterclockwise rotation (FIG. 2) of the football as it is projected from the device, as explained hereinbefore.

Let it now be assumed that the device is to function to throw footballs end-over-end, in the manner of a kick-off. For this purpose the wheels are adjusted to the same transverse plane, reducing the included angle A substantially to zero. The socket member 56 and cradle 62 then are raised relative to the carriage beam 46, to elevate the longitudinal axis of the football above the midpoint 44. Alternatively, the socket member and cradle member may be adjusted relative to the carriage beam so that the longitudinal axis of a football is inclined forwardly relative to the longitudinal axis of the carriage beam. In either case, when the football is moved forwardly into contact with the now parallel planes of movement of the confronting surfaces of the tires, the football is engaged by said surfaces below its longitudinal centerline and thus is projected from the device with rotation on its tranverse axis, in the manner of an end-over-end kick-off.

From the foregoing it will be appreciated that the present invention provides a device of relatively simplified construction for economical manufacture and easy portability, providing mechanical means by which to throw footballs in manners simulating a wide range of types of passes as well as punts and kick-offs, with reproducible accuracy.

It will be apparent to those skilled in the art that various changes may be made in the size, shape, type, number and arrangement of parts described hereinbefore. For example, the wheels 14 and 16 may be secured to the supporting frame 20 in fixed angular position for throwing a football only with rotation on its longitudinal axis. The device also may be provided with the wheels fixed in a common transverse plane and with the football supporting saddle 62 and socket member 56 fixed in position such that the confronting surfaces of the tires engage the football below its longitudinal centerline, for throwing a football only with rotation on its transverse axis, in the manner of an end-over-end kick-off. Further, the pair of wheels may be replaced by a pair of other types of movable members, such as a pair of endless belt assemblies which converge forwardly from a spacing which is greater than the diameter of a football to a spacing which is less than the diameter of the football. The arrangement of motor 34 and drive cable 36 may be replaced by a motor and gear arrangement, or by any other conventional drive which provides for rotating both wheels at the same speed. The spacing between the confronting surfaces of the tires may be varied to accommodate the throwing of footballs of various sizes, whereby the device may be utilized by youngsters of grade school age, as well as by high school, college and professional players. This variable spacing may be provided by a plurality of replaceable frames 20 of various widths, or by a single, laterally adjustable frame 20. These and other modifications and changes may be made, as desired, without departing from the spirit of this invention.

Having now described our invention and the manner in which it may be used, we claim:

1. A football throwing device, comprising:

a. only one pair of movable members providing a pair of mutually confronting football gripping surfaces spaced apart laterally a distance slightly less than the maximum diameter of a football, b. drive means engaging the movable members for moving said confronting surfaces simultaneously and at the same rate of speed in a forward, football projecting direction, and c. rotary means mounting the pair of movable members for said forward movement of said confronting surfaces in planes which cut through the movable members perpendicular to the axes of rotation of the rotary means and which planes form between them an included acute angle selected to effect projection of a football with a predetermined rotation.

2. The football throwing device of claim 1 wherein the mounting means is adjustable for adjusting said planes to diverse angular relationships.

3. The football throwing device of claim 1 wherein the mounting means is adjustable for reversing the acute angular disposition of said planes of the movable members one relative to the other for reversing the axial rotation of a football projected therefrom.

4. The football throwing device of claim 3 wherein the mounting means is also adjustable for disposing said confronting surfaces in a common plane, whereby to accommodate projection of a football therefrom with rotation on its transverse axis.

5. The football throwing device of claim 1 wherein the mounting means mounts the movable members for said forward movement of said confronting surfaces substantially in a common plane for engaging a football below its longitudinal centerline and effecting rotation thereof on its transverse axis.

6. The football throwing device of claim 5 including a football infeed carriage having means for supporting a football and movable toward and away from said confronting surfaces on a line extending between said confronting surfaces for engaging the latter below the centerline of the football.

7. The football throwing device of claim 1 including football infeed means for introducing a football between said confronting surfaces.

8. The football throwing device of claim 7 wherein the football infeed means comprises a carriage having means for supporting a football and movable toward and away from said confronting surfaces on a line extending between said confronting surfaces.

9. The football throwing device of claim 8 wherein the carriage includes adjustable football support means for adjusting the longitudinal axis of a football relative to said planes.

10. The football throwing device of claim 1 including base means supporting the mounting means elevated above ground for pivotal adjustment of the movable members about horizontal and vertical axes, the vertical axis and a vertical plane through the horizontal axis both being disposed perpendicular to said football projecting direction.

11. The football throwing device of claim 1 wherein the mounting means is adjustable for adjusting said planes to diverse angular relationships including reversible acute angles and disposition in a common plane, and including a football infeed carriage movable toward and away from said confronting surfaces on a line extending between said confronting surfaces, the carriage including adjustable football support means for adjusting the longitudinal axis of a football relative to said planes.

* * * * *